United States Patent [19]

Tango et al.

[11] Patent Number: 4,583,266

[45] Date of Patent: Apr. 22, 1986

[54] PROCESS FOR PREPARATION OF DISCONTINUOUS FILAMENT BUNDLES AND SHARP-ENDED FILAMENTS

[75] Inventors: Yasuo Tango, Fuji; Makoto Kanazaki, Shizuoka, both of Japan

[73] Assignee: Asahi Kasei Kogyo Kabushiki Kaisha, Osaka, Japan

[21] Appl. No.: 774,852

[22] Filed: Sep. 9, 1985

Related U.S. Application Data

[63] Continuation of Ser. No. 427,214, Sep. 29, 1982, abandoned.

[30] Foreign Application Priority Data

| | | | |
|---|---|---|---|
| Oct. 5, 1981 | [JP] | Japan | 56-157420 |
| Oct. 6, 1981 | [JP] | Japan | 56-158196 |
| May 21, 1982 | [JP] | Japan | 57-86210 |

[51] Int. Cl.[4] ..... D01G 1/08

[52] U.S. Cl. ..... 19/0.39; 19/0.46

[58] Field of Search ..... 19/0.37, 0.46

[56] References Cited

U.S. PATENT DOCUMENTS

| | | | |
|---|---|---|---|
| 2,096,795 | 10/1937 | Dreyfus | 19/0.37 |
| 2,649,623 | 8/1953 | Ingham | 19/0.37 |
| 2,976,578 | 3/1961 | Virgil | 19/0.37 |
| 3,287,787 | 11/1966 | Goulding et al. | 19/0.37 |

*Primary Examiner*—Louis K. Rimrodt

*Attorney, Agent, or Firm*—Sprung Horn Kramer & Woods

[57] ABSTRACT

A process for the preparation of discontinuous filament bundles, which comprises applying a drawing force and/or a shearing force to a bundle of continuous filaments while or immediately after contacting the bundle of continuous filaments with a medium maintained at a temperature lower than −5° C. to cut the respective single filaments constituting the bundle. The individual filaments of the resultant bundle may have on at least one terminal thereof a sharp end cut obliquely and an inclination angle $\alpha$ of the cut top end to the filament axis of less than 70°.

1 Claim, 28 Drawing Figures

Fig. 16
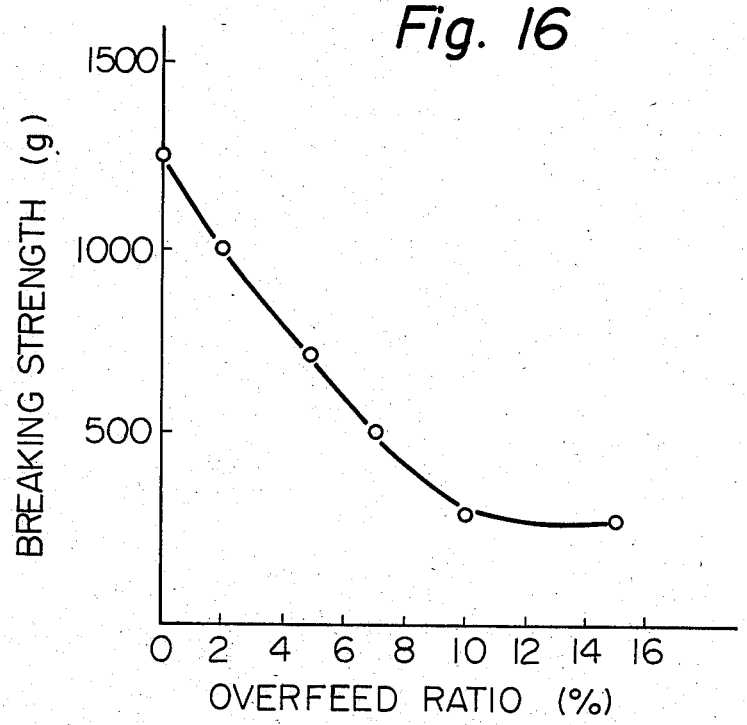
Fig. 17A
Fig. 17B
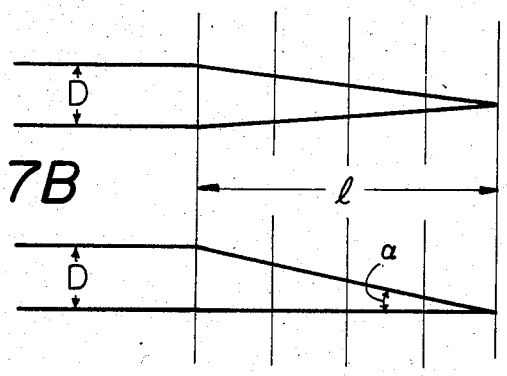

PROCESS FOR PREPARATION OF DISCONTINUOUS FILAMENT BUNDLES AND SHARP-ENDED FILAMENTS

This application is a continuation, of application Ser. No. 427,214, filed 9.29.82 now abandoned.

BACKGROUND OF THE INVENTION

The present invention relates to a process for the preparation of a bundle of discontinuous filaments which is an intermediate product for use in preparing spun yarns from a bundle of continuous filaments, such as a tow or multifilament.

As the known process for the preparation of spun yarns, there can be mentioned a process in which staple fibers are passed through the carding step, the gilling or drawing step, the roving step, and the spinning step. This process, however, involves the following problems because it comprises the carding step:

(1) The productivity is low.

(2) Shrinkability cannot be given to a spun yarn at the spinning step.

(3) At the start of the fiber-preparing step, it is necessary to cut the fibers into stable fibers having a length suitable for the object of spinning.

(4) At the carding step, neps (entanglements of single fibers) and hooks (bends of the top ends of single fibers) are formed, and the degree of parallelization or parallelism in single fibers is low. Hence, means for prolonging the gilling step or other special means become necessary.

As the process comprising converting a bundle of continuous filaments, such as a tow or multifilament, into a bundle of discontinuous filaments and forming a spun yarn from the bundle of discontinuous filaments, there is known a process in which a bundle of discontinuous filaments is formed at a temperature close to room temperature according to the Perlohrke system or Turbo system.

According to the Perlohrke system, a bundle of continuous filaments is drawn by rollers to cut the respective single filaments, the intention being to obtain a bundle of discontinuous filaments having a high degree of parallelization at a high speed. As can be seen from the strength-elongation curve (determined at a temperature of 20° C. and a relative humidity of 65%) of acrylic-type synthetic fibers (marketed under the tradename of Cashmilon ®), shown in FIG. 10, at the cutting step of this method, filaments are passed through a region of elastic deformation in which the filaments are stretched up to about 5% and then are passed through a region of plastic deformation in which the filaments are stretched more than 5%, i.e., the filaments are stretched to the point of elongation at breakage to effect cutting of the filaments. Accordingly, the following problems arise when the Perlohrk system is adopted:

(1) Under ordinary spinning conditions, a large residual strain is given to filaments by the cutting operation, and, therefore, the production of spun yarns having a low shrinkage degree is limited.

(2) Since the strength and elongation, especially the loop elongation and loop strength, are drastically reduced by the cutting operation, breakage of the filaments or flying of the filaments frequently occurs in the process for preparing spun yarns.

(3) When filaments having a high elongation are drawn and cut, since preliminary drawing is first carried out and draw-cutting is then effected according to the Perlohrke system, the defect mentioned in the preceding paragraph (2) is augmented.

(4) The top ends of cut filaments become frizzled, resulting in a reduction of the quality in spun yarns, especially in direct spun yarns.

According to the Turbo system, a bundle of continuous filaments is cut by applying a shearing force while the bundle is being drawn. In this method, it is not necessary to stretch filaments to the point of elongation at breakage, but the above-mentioned defects (1) through (3) are not substantially eliminated, and the staple diagram of the cut filaments is degraded, that is, the amount of excessively long fibers and short fibers is increased.

BRIEF SUMMARY OF THE INVENTION

It is a primary object of the present invention to provide a process in which the above-mentioned defects of the conventional methods are eliminated. More specifically, the present invention provides a process for the preparation of bundles of discontinuous filaments in which high-speed production of high-quality spun yarns without breakage of or flying of the filaments is possible, the above-mentioned defects of the conventional methods being eliminated, and not only spun yarns having a low shrinkage degree but also spun yarns having a high shrinkage degree can optionally be prepared.

The present invention provides a process for the preparation of discontinuous filament bundles which comprises applying a drawing force and/or a shearing force to a bundle of continuous filaments while or immediately after contacting the bundle of continuous filaments with a medium maintained at a temperature lower than −5° C. to cut the respective single filaments constituting the bundle.

DESCRIPTION OF THE DRAWINGS

FIG. 16 is a diagram illustrating the relationship between the overfeed ratio and the breaking strength;

FIGS. 17A and 17B are side views showing the conical top end of the cut filament and the obliquely cut columnar top end of the cut filament, respectively;

DESCRIPTION OF THE PREFERRED EMBODIMENTS

Figure 1:
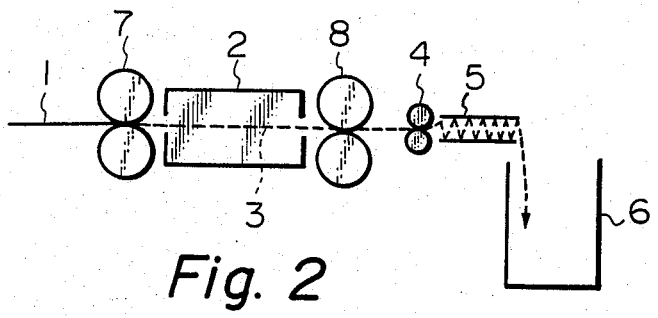
FIGS. 1 through 7 are step diagrams illustrating embodiments of the process of the present invention.

As the bundle of continuous filaments, a tow or multifilament is ordinarily used in the present invention. As the continuous filaments, there are used synthetic fibers such as polyamide, polyester, polyacrylic, modified polyacrylic, polyurethane, polyvinyl chloride, and vinylon fibers, semi-synthetic fibers such as acetate fibers, and regenerated man-made fibers such as rayon and cupra fibers. Acrylic-type synthetic fibers are especially preferably used. As the bundle, there are ordinarily used filaments large filaments and tows having a single filament denier of 0.1 to 60 d and a total denier of 30 to 2,000,000 d. A mixture of this bundle of continuous filaments with a bundle of staple fibers or a bundle of other fibers may be used.

If this bundle of continuous filaments is contacted with a medium maintained at a temperature lower than −5° C., the rigidity of the filaments is increased and the elongation is very low (the region of elastic deformation). According to the present invention, the cutting of respective single filaments constituting the filament bundle is performed in this state. This cutting is carried out while or just after contacting the filament bundle with a medium maintained at a temperature lower than −5° C.

If the contact temperature exceeds −5° C. and is close to normal temperature (about 20° C.), the elongation of the filaments is increased and the residual strain of the filaments due to cutting is increased, with the result that it becomes difficult to obtain spun yarns having a low degree of shrinkage, the defects of the Perlohrke system and the Turbo system are manifested, and the objects of the present invention cannot sufficiently be attained.

In order to enhance the effects of the present invention more satisfactorily, it is preferred that the temperature of the medium be lower than −20° C., preferably lower than −40° C.

In the case where a low-shrinkage yarn is prepared according to the stretch-breaking system, there is present a lower limit of the degree of shrinkage determined according to the kind of starting fiber, and a variety of starting fibers should be used in accordance with the intended degree of shrinkage. If a starting fiber having a reduced tendency to shrink is used, since the fiber is readily cut, the formation of flies becomes conspicuous and the staple diagram is degraded. Accordingly, the obtained spun yarn is poor in respect to elongation, and due to unevenness and the formation of flies at the subsequent processing step, the quality of the spun yarn is degraded. In the present invention, this problem can be solved. Namely, according to the present invention, by using starting fibers having high shrinkage characteristics and by cutting the sliver at a temperature lower than −5° C., it is possible to attain a high degree of shrinkage comparable to the high degree of shrinkage attainable when starting fibers having a low degree of shrinkage are used. If the cutting temperature is lower than −20° C., it is possible to obtain a bundle of discontinuous filaments having a low degree of shrinkage irrespectively of the properties of the starting fibers. If the cutting temperature is lower than −40° C., it is possible to attain a shrinkage degree of less than 4% very stably.

The lower limit of the cutting temperature is 0° K. according to the absolute temperature scale, but too low a temperature is not preferred in view of the cost of the medium used or the apparatus limitation; therefore, a temperature of −20° C. to −195° C. is preferred.

Any medium can be used in the present invention as long as the temperature is lower than −5° C. For example, there may be used gases and gasifiable liquids such as ammonia, carbon dioxide, air, oxygen, and nitrogen and freezing mixtures such as mixtures of alcohols or ethers with solid carbonic anhydride and mixtures of ice with chlorides, nitrates, or sulfates such as zinc chloride, sodium chloride, sodium nitrate, and sodium sulfate. Furthermore, there may be adopted an electrically cooling method.

The time for contacting the bundle with the cooling medium varies according to the kind of fiber, the sliver-supplying method, and the kind of or temperature of the cooling medium, but, ordinarily, the contact time is about 0.1 seconds to 100 minutes, preferably 0.1 seconds to 10 minutes.

The method for contacting the bundle with the cooling medium is not particularly critical and there may be adopted, for example, a method in which the bundle of continuous filaments is contacted With the surface of the cooling member, a method in which the bundle of continuous filaments is passed through an atmosphere of the cooling gas or through the cooling liquid, and a method in which the cooling medium is dropped on the bundle of continuous filaments.

Cutting of the bundle of continuous filaments may be carried out either while or immediately after contacting the bundle with the medium maintained at a temperature lower than −5° C.

Cutting is accomplished by applying a drawing force and/or a shearing force to the bundle of continuous filaments, whereby the respective single filaments are cut. Another cutting force may be applied in combination with the drawing force and/or the shearing force. It is preferred that tows or multifilaments of a certain uniform width and a uniform thickness be supplied to the cooling zone. If the cutting operation is thus carried out, a bundle of discontinuous filaments having a good staple diagram can be obtained. As the obtained bundle of discontinuous filaments, there can be mentioned slivers, rovings, direct spun yarns, and spun yarns.

Figure 9:
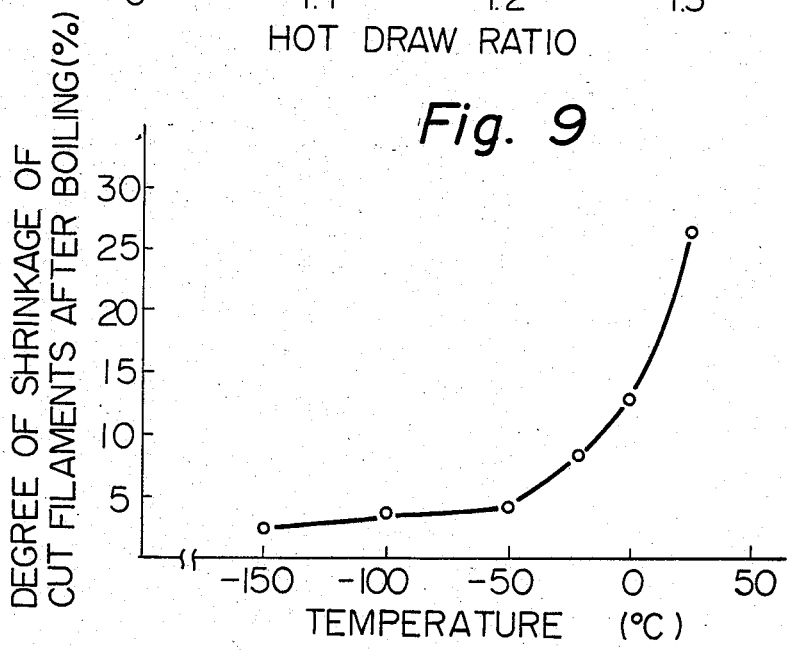
FIG. 9 is a diagram illustrating the relationship between the temperature of the cooling medium at the cutting step and the degree of shrinkage of cut filaments after boiling.
Figure 10:
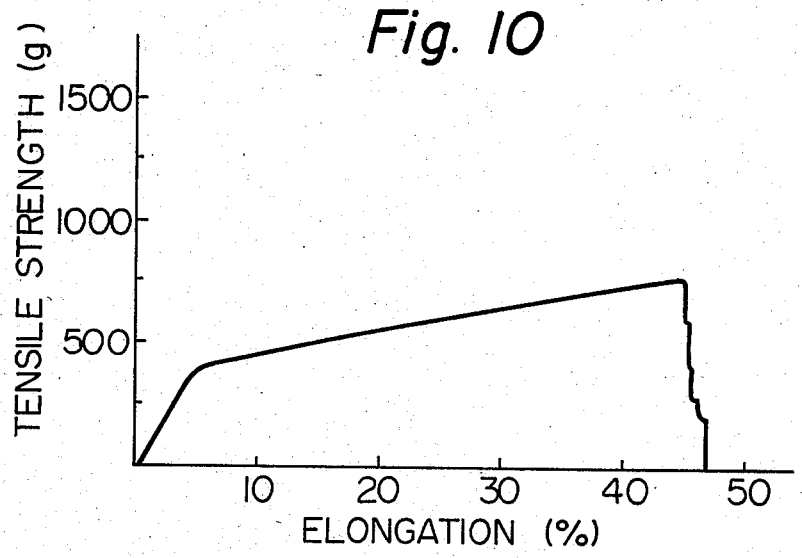
FIG. 10 is a strength-elongation curve of synthetic acrylic filaments (marketed under the tradename of Cashmilon ®) determined at a temperature of 20° C. and a relative humidity of 65%.

FIG. 9 is a diagram illustrating the relationship between the temperature of the cooling medium and the shrinkage degree of the single filaments constituting the bundle, which relationship is observed when acrylic filaments (marketed under the tradename of Cashmilon ®) are contacted, under a load of 100 mg/d, with the cooling medium at various temperatures. From this graph, it will readily be understood that according to the present invention, either low degrees of shrinkage or high degrees of shrinkage can optionally be attained.

Figure 8:
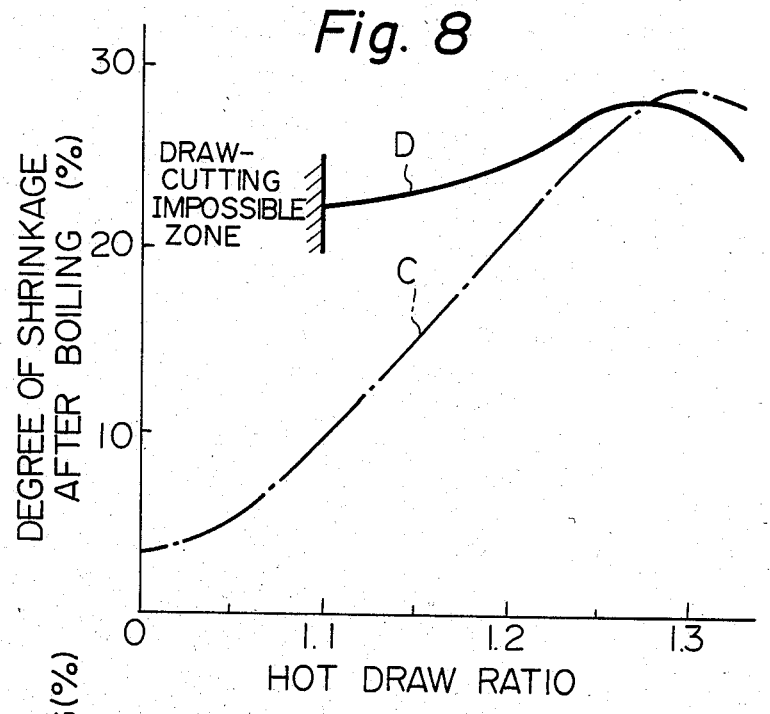
FIG. 8 is a diagram illustrating the relationship between the hot-draw ratio and the degree of shrinkage after boiling.

If a certain temperature is set for the medium at the cooling step, the shrinkage degree of single filaments is determined according to this temperature. A shrinkage degree higher than the thus-determined shrinkage degree can be attained by performing drawing, preferably hot drawing, prior to the contact with the medium maintained at a temperature lower than −5° C. C in FIG. 8 illustrates the change of the degree of shrinkage observed when acrylic filaments (marketed under the tradename of Cashmilon ®) are subjected to hot drawing in advance and are then cut while contacting them with a cooling medium maintained at −50° C. When hot drawing is not carried out, the shrinkage degree is 4% (see FIGS. 8 and 9), but with an increase of the draw ratio at the hot-drawing operation, the degree of shrinkage is increased. D in FIG. 8 shows the degree of shrinkage observed when cutting is carried out according to the Perlohrke system. In this case, the degree of shrinkage can be adjusted only within the range of from 23% to 28%.

According to the present invention, since a bundle of discontinuous filaments is prepared by contacting a bundle of continuous filaments with a cooling medium maintained at a temperature lower than −5° C., the following prominent effects can be attained:

(a) By changing the temperature of the cooling medium, a spun yarn having an optional shrinkage degree in a range of from a low degree of shrinkage to a high degree of shrinkage can be prepared.

(b) If a drawing treatment is carried out prior to cutting, the degree of shrinkage can be adjusted to an optional level.

(c) The formation of flies or breakage of filaments is drastically reduced at the spinning step.

(d) A spun yarn prepared from the bundle of discontinuous filaments obtained according to the process of the present invention is substantially free from yarn unevenness, and the yarn tenacity is very high.

In accordance with the second aspect of the present invention, there is provided a process comprising applying a drawing force and/or a shearing force to a bundle of continuous filaments composed of acrylic-type synthetic fibers having crimps while or immediately after contacting the bundle with a cooling medium maintained at a temperature lower than −20° C., preferably lower than −40° C. and more preferably lower than −80° C., in a cooling zone in the crimp-retained state to cut the respective single filaments.

In accordance with the third aspect of the present invention, there is provided a process for the preparation of bundles of discontinuous filaments, which process comprises applying a drawing force and/or a shearing force to a bundle of continuous filaments composed of acrylic-type synthetic fibers having crimps while or immediately after contacting the bundle with a cooling medium maintained at the above-mentioned temperature in a cooling zone in the state where the crimps are retained by overfeeding the bundle to cut the respective single filaments.

Figure 13:
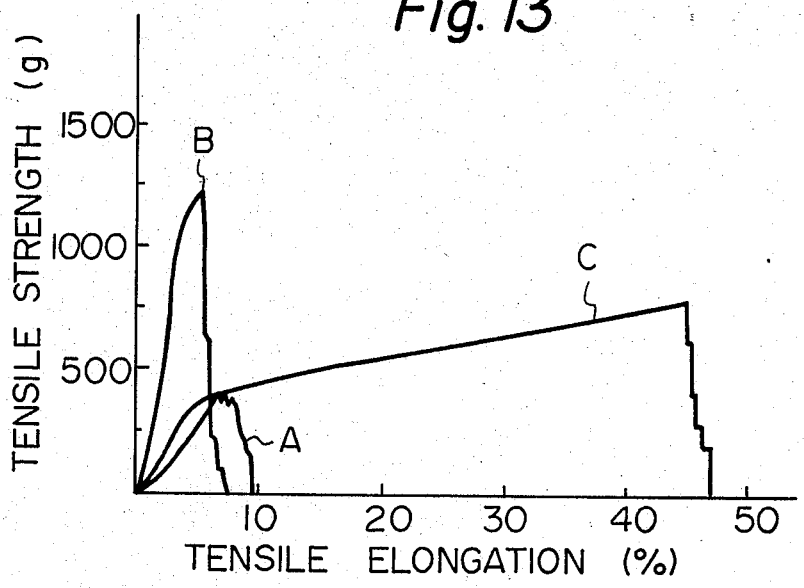
FIG. 13 is a diagram illustrating the relationship between tensile elongation and tensile strength in acrylic synthetic filaments (marketed under the tradename of Cashmilon ®) having crimps.

A in FIG. 13 shows a strength-elongation curve obtained when acrylic filaments (marketed under the tradename of Cashmilon ®) having crimps are drawn in a state where the filaments are contacted with nitrogen gas maintained at −100° C. for 45 seconds while the crimps are retained, and B in FIG. 13 shows a strength-elongation curve obtained when the above filaments are drawn in a state where the filaments are contacted with nitrogen gas maintained at −100° C. for 45 seconds while the crimps are removed.

Figure 14:
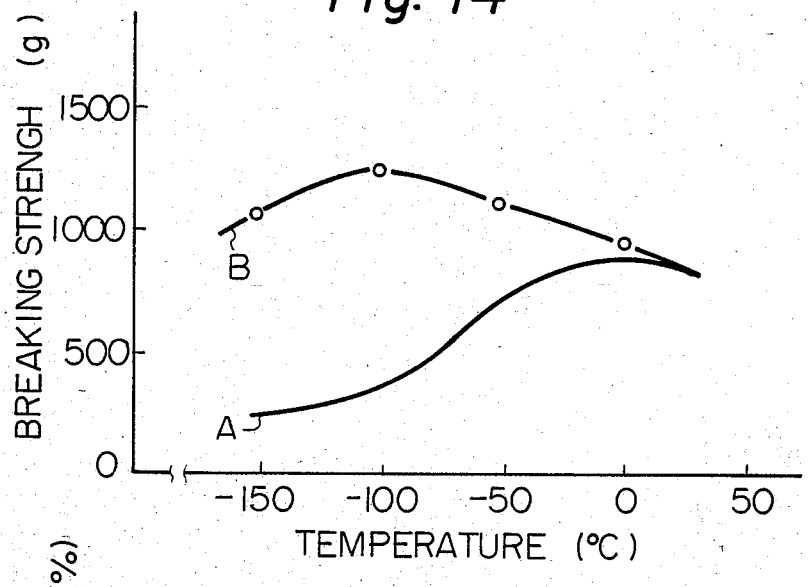
FIG. 14 is a diagram illustrating the relationship between the temperature of the cooling medium at the cutting step and the breaking strength.

A in FIG. 14 shows a curve of the breaking strength of acrylic filaments after they stand for 1 minute at respective temperatures while crimps are retained, and B in FIG. 14 shows a curve of the breaking strength after the same treatment in a state where the crimps are sufficiently elongated. It can be seen that when the bundle is contacted with the cooling medium maintained at a temperature lower than −20° C. in the crimp-retained state to set the crimps, the force necessary for cutting is reduced by 10% as compared with the cutting force required when cooling is effected in the crimp-elongated state. This force necessary for cutting is comparable to the cutting force required in the conventional stretch-breaking method. If the bundle is contacted with a medium maintained at a temperature lower than −40° C., there can be obtained a bundle of discontinuous filaments in which the filament damages are remarkably reduced, the formation of flies or the manifestation of shrinkage is controlled, and the physical properties are improved with a good parallelism and a good evenness while defects such as neps are eliminated. If the bundle is contacted with the medium maintained at a temperature lower than −80° C., cutting becomes possible with a force less than one half of the cutting force required in the conventional stretch-breaking method.

Figure 11A:
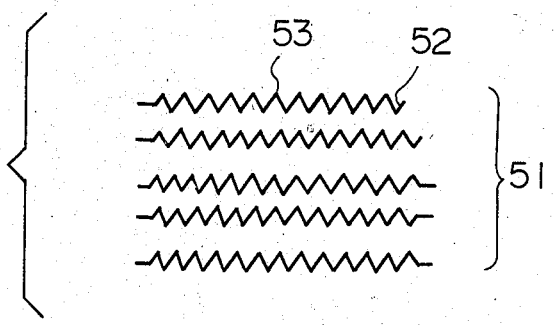
FIGS. 11A and 11B are views diagrammatically illustrating the states of crimps.
Figure 11B:
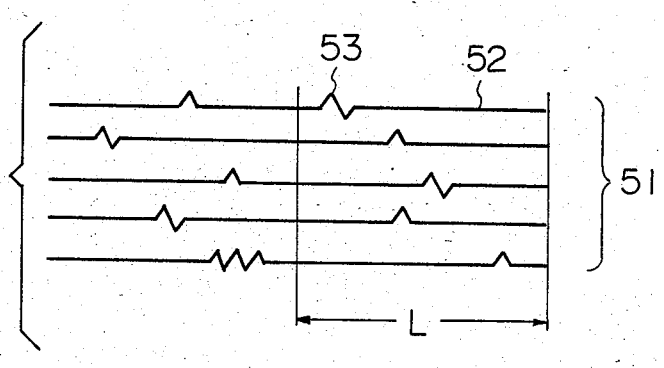

The state of crimps will now be described with reference to FIGS. 11A and 11B. Crimps 53 of single filaments 52 constituting a bundle 51 of continuous filaments in the axial direction may be continuously present, as shown in FIG. 11A, or at least one crimp 53 may be present in the region of the cutting length L, as shown in FIG. 11B. It is preferred that crimps be randomly present in the axial direction in the bundle of continuous filaments 51. Furthermore, it is preferred that the bundle of continuous filaments having such crimps be fed into the cooling zone in the state where the bundle is uniformly divided into single filaments of a certain width and a certain arranged thickness.

In the present invention, in order to reduce the cutting energy, it is especially preferred that the bundle of continuous filaments be supplied into the cooling zone by overfeeding. More specifically, the bundle is cut while or immediately after contacting the bundle with the cooling medium maintained at a temperature lower than −20° C. while retaining the original crimps as much as possible by overfeeding.

FIG. 16 shows the breaking strength observed when a bundle of continuous filaments composed of acrylic-type synthetic fibers having crimps (consisting of 100 single filaments having a denier of 3 d) is supplied to a cooling zone maintained at −100° C. for 45 seconds at various overfeed ratios. It will readily be understood that with an increase of the overfeed ratio, the breaking strength, that is, the force necessary for cutting, is reduced.

Figure 12:
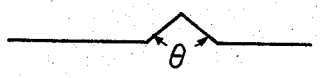
FIG. 12 is a diagram illustrating the crimp angle.

In the present invention, it is preferred, when the bundle is fed into the cooling zone, that at least one crimp be present in the cutting zone length L of each single filament and that the angle $\theta$ of the crimp be in the range of $0° < \theta \leqq 120°$, more preferably $10° \leqq \theta \leqq 120°$, as shown in FIG. 12.

Incidentally, the angle $\theta$ is a value as measured under a load of 2 mg/d.

Any medium can be used in the present invention as long as the temperature is lower than −20° C. For example, there may be used gases and gasifiable liquids such as ammonia, carbon dioxide, air, oxygen, and nitrogen and freezing mixtures such as mixtures of alcohols or ethers with solid carbonic anhydride and mixtures of ice with chlorides, nitrates, or sulfates such as zinc chloride, sodium chloride, sodium nitrate, and sodium sulfate. Furthermore, there may be adopted an electrically cooling method.

The time for contacting the bundle with the cooling medium varies according to the kind of fiber, the sliver-supplying method, and the kind of or temperature of the cooling medium, but, ordinarily, the contact time is about 0.1 seconds to 100 minutes, preferably 0.1 seconds to 10 minutes.

The method for contacting the bundle with the cooling medium is not particularly critical, and there may be adopted, for example, a method in which the bundle of continuous filaments is contacted with the surface of the cooling member, a method in which the bundle of continuous filaments is passed through an atmosphere of the cooling gas or through the cooling liquid, and a method in which the cooling medium is dropped on the bundle of continuous filaments.

Cutting of the bundle of continuous filaments may be carried out either while or immediately after contacting the bundle with the medium maintained at a temperature lower than −20° C.

Cutting is accomplished by applying a drawing force and/or a shearing force to the bundle of continuous filaments, whereby the respective single filaments are cut. Another cutting force may be applied in combination with the drawing force and/or the shearing force. If the cutting operation is thus carried out, a bundle of discontinuous filaments having a good staple diagram can be obtained. As the obtained bundle of discontinuous filaments, there can be mentioned slivers, rovings, direct spun yarns, and spun yarns.

According to the present invention, since a bundle of discontinuous filaments is prepared by contacting a bundle of continuous filaments with a cooling medium maintained at a temperature lower than −20° C., the following prominent effects can be attained:

(a) When a bundle of discontinuous filaments is prepared by cutting a bundle of continuous filaments in the crimp-retained state, the energy necessary for cutting is very small.

(b) By changing the temperature of the cooling medium, a spun yarn having an optional shrinkage degree in a range of from a low degree of shrinkage to a high degree of shrinkage can be prepared.

(c) By changing the temperature of the cooling medium, crimps can be left in the single filaments after cutting, and a bundle of discontinuous filaments having a good spinnability, a high degree of parallelization, and a high bulkiness can be obtained.

(d) If a drawing treatment is carried out prior to cutting, the degree of shrinkage can be adjusted to an optional level.

(e) The formation of flies or the breakage of filaments is drastically reduced at the spinning step.

(f) A spun yarn prepared from the bundle of discontinuous filaments obtained according to the method of the present invention is substantially free from yarn unevenness, and the yarn tenacity is very high.

Single filaments having sharp ends, which are obtained according to the process of the present invention, and spun yarns containing at least 15% of these single filaments will now be described.

A single filament obtained according to the process of the first, second, or third aspects of the present invention has on at least one terminal thereof a sharp end cut obliquely to the direction of the filament axis, and the inclination angle $\alpha$ of the cut top end to the filament axis is less than 70°.

This sharp-ended filament has a soft and smooth touch like that of fur, has a good elasticity, and is very valuable as a filament for artificial leather, a wool-like filament, or a hair-like filament. Moreover, this sharp-ended filament is characterized in that breakage of the filament or the formation of flies is effectively controlled at post-treatments such as spinning.

Various filaments having sharp ends have heretofore been proposed. For example, there can be mentioned a method in which thick-thin filaments or islands-in-a-sea filaments are prepared in starting fibers or bundles thereof, a method in which filaments are drawn or cut by contacting them with hot air or a hot plate at the post-processing step, a method in which the top ends of filaments are mechanically polished, and a method in which the top ends of filaments are sharpened by dissolving the top ends in a solvent or the like. Also, a method in which top ends of filaments are tapered by contacting them with a grinding material at a temperature of −190° C. to −30° C. has been proposed in Japanese Unexamined Patent Publication (Kokai) No. 55-142736. In each of these methods, the top ends of filaments are processed in the staple state, and in order to form these filaments into products such as spun yarns, woven fabrics, knitted fabrics; or nonwoven fabrics or intermediate products such as slivers or rovings, these filaments must be passed through various processing steps such as spinning. The top ends of these filaments have a needle-like sharp conical shape, a rounded rotary paraboloidal shape, or a frustoconical shape such as a trapezoidal shape. Filaments having needle-like sharp conical ends have a good feel to the touch, but they are poor in respect to adaptability to processing, such as spinning, and breakage of the filament and, consequently, the formation of flies takes place. Moreover, in the production of sharp-ended filaments of this type, thick-thin filaments or islands-in-a-sea filaments must be prepared in starting fibers or bundles thereof, the spinning method and polymerization method are very complicated, and the productivity is very low. Furthermore, the top ends must be heated to a molten state for sharpening the top ends at post-treatment, and, therefore, the problem of fusion and adhesion arises. When a solvent is used, there are involved various problems in the disposal of the solvent, the disposal of the dissolved component, the quality of the filaments, and the manufacturing cost. There is not known a method in which filaments having conical top ends or rotary paraboloidal top ends are mechanically formed in a continuous manner at the post-processing step.

As was pointed out hereinbefore, as sharp-ended filaments, there are known filaments having sharp conical top ends, rounded rotary paraboloidal top ends, or frustonical top ends, such as trapezoidal top ends. Filaments having sharp conical top ends have a good feel to the touch, but the processability is poor and breakage of the filaments or the formation of flies readily occurs.

The sharp top end and the shape of the top end are very important in the production of a high-grade material and have a significant influence on the feel and softness of the yarn or product. Moreover, the sectional area of the top end is significant in view of post-processability and spinnability and has an influence on the occurrence of filament breakage or the formation of flies and, consequently, on the processing capacity and quality. Therefore, it is very significant to specify the shape of the top end of the sharp-ended filament.

The influence of the shape of the top end on the physical properties in the case of a filament having a circular section will now be diagrammatically illustrated with reference to FIGS. 17 and 18.

Figure 18:
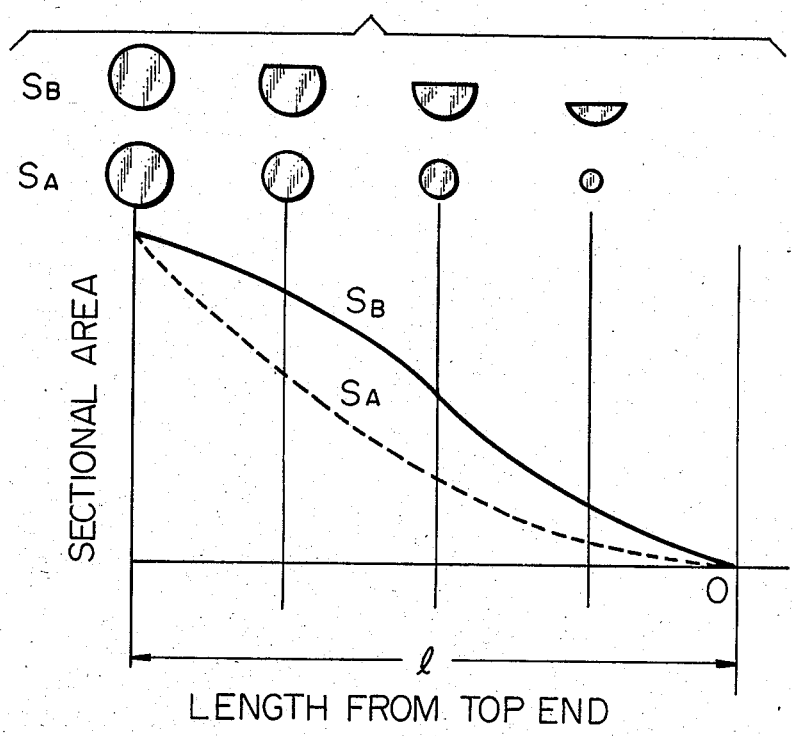
FIG. 18 is a graph illustrating the relationship between the length l from the top end and the sectional area in a filament having a conical cut end and a filament having an obliquely cut end.

In the case where the top end has a conical shape, as shown in FIG. 17A, the top end is sharpened and, simultaneously, the diameter D and sectional area $S_A$ are gradually reduced, as shown in FIG. 18. Accordingly, if the length of the top end portion is increased, breakage of the filament or the formation of flies takes place.

In contrast, in the case where the top end has an obliquely cut columnar shape, as shown in FIG. 17B, the top end is sharpened, but even if the length l of the top end portion is increased, as shown in FIG. 18, the sectional area $S_B$ is larger than that of the filament having a conical top end, as shown in FIG. 17A, and breakage of the filament and the formation of flies are controlled. If the top end is sharpened, the shape of the section becomes more arcuate toward the tip and the degree of non-circularity is increased. Accordingly, the sectional area is larger, and the filament has a higher resiliency, than in the case of the circular section of the conical top end when a comparison is made at the same distance from the tip, whereby the feel to the touch is smoother and softer than in the case of a circular top end of the same sectional area.

In the present invention, the shape of the top end is defined by the inclination angle $\alpha$ of the top end in the direction of the filament axis, as shown in FIG. 17B.

In the filament of the present invention, it is indispensable that one end thereof be obliquely cut so that the inclination angle $\alpha$ of the cut top end is less than 70°. The smaller the angle $\alpha$ is, the sharper the top end is and the higher the degree of arcuate non-circularity is, with the result that the filament is smoother and softer to the touch. However, if the angle is too small, the sectional area is reduced and breakage of the filament or the formation of flies takes place. In order to control breakage of the filament or the formation of flies, it is preferred that the inclination angle of the top end be in the range of $\alpha \geqq 5°$. On the other hand, in order to obtain a smooth and soft feel to the touch, it is preferable that the inclination angle $\alpha$ of the top end be in the range of $\alpha \leqq 45°$ and more preferable that the inclination angle of the top end be in the range of $5° \leqq \alpha \leqq 30°$. In this case, a sharp-ended filament having an obliquely cut end which has an excellent feel to the touch and an excellent post-processability, such as spinnability, can be obtained.

The top end of the filament of the present invention obtained by cutting the filament in the above-mentioned manner is illustrated in detail in FIG. 20. In FIG. 20A, the top end of the filament has a section of one plane having a substantially uniform inclination angle $\alpha$, but in each of the filaments shown in FIGS. 20B, 20C, 20D, and 20E, the section of the top end has substantially one plane of the inclination angle $\alpha$ but it has on the base thereof a cut face rectangular to the filament axis or inclined in the direction opposite to the inclination angle $\alpha$. In the filament shown in FIG. 20F, the top end of the filament has two discontinuous cut faces inclined in substantially the same direction toward the filament axis and an intruded face formed between the two cut faces. For example, when 3-denier acrylic filaments (Cashmilon, supplied by Asahi Kasei Kogyo K. K.) are cut according to the present invention, the frequency of appearance of the top end shapes of the cut filaments is as expressed by (A) >(B) >(D) >(F), and in the majority of the cut filaments, the angles $\alpha$ are included in the range of $5° \leqq \alpha \leqq 30°$. When 15-denier filaments are cut, the frequency of appearance of the shape (B) is the highest, the majority of the cut filaments have top ends having the top end shapes (B) and (A), and the angles $\alpha$ are in the range of $5° \leqq \alpha \leqq 30°$. In the case of 3-denier cupra filaments (Bemberg, supplied by Asahi Kasei Kogyo K. K.), most of the cut filaments have top ends having the shape (A), and in the majority of the cut filaments, the angles $\alpha$ are in the range of $30° \leqq \alpha \leqq 50°$.

Figure 21:
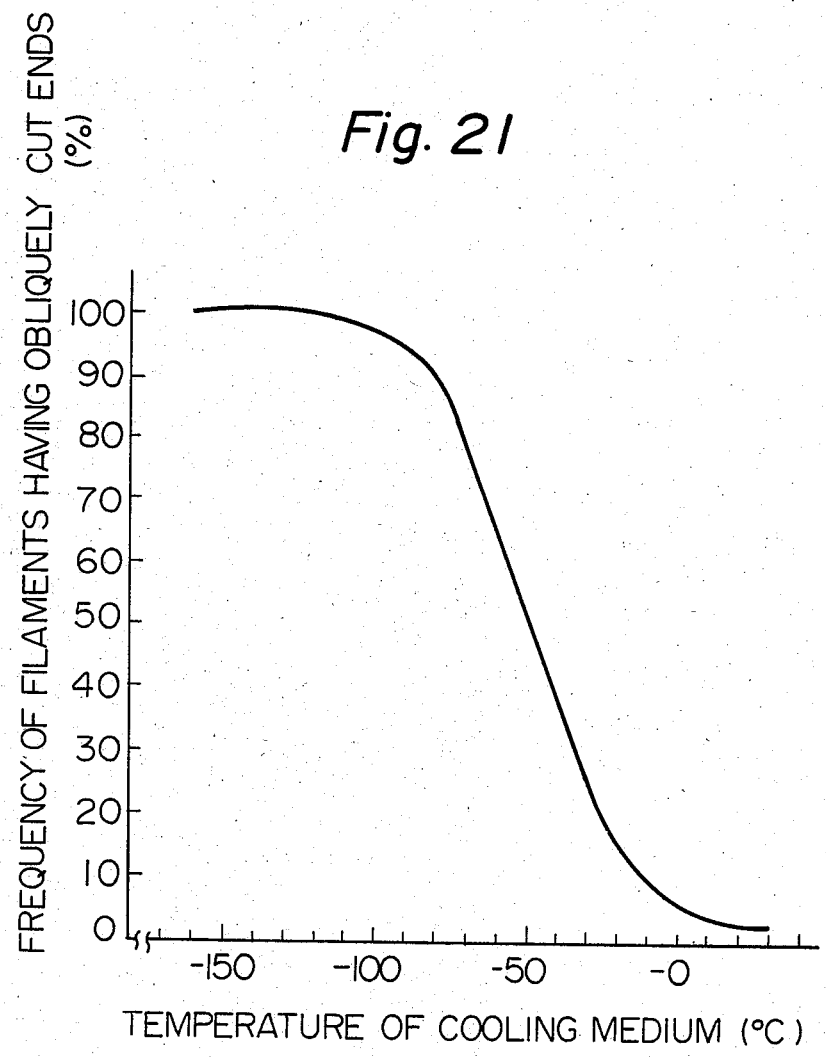
FIG. 21 is a graph illustrating the relationship between the temperature of the cooling medium and the frequency of filaments having obliquely cut ends.

FIG. 21 is a diagram showing the relationship between the temperature of the cooling medium and the frequency of single filaments having an obliquely cut end in the bundle of discontinuous filaments observed when acrylic fibers (marketed under the tradename of Cashmilon ®) are cut under a load of 100 mg/d while contacting them with the cooling medium at various temperatures. As can be seen from this graph, in the present invention, the mixing ratio of the sharp-ended filaments in the bundle of discontinuous filaments can be appropriately adjusted according to the intended use. Namely, discontinuous filament bundles having an optional mixing ratio in the range of from a low level to 100% can optionally be provided according to the present invention.

Figure 19:
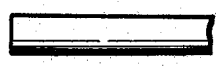
FIG. 19 is a side view illustrating the top end of a draw-broken filament through plastic deformation.

The filaments of the present invention can be used singly or together with other known filaments. Ordinarily, it is preferred that the content of the sharp-ended filaments of the present invention be at least 15%. Mixing may be performed at the spinning step or the like. Moreover, if the respective single filaments of a bundle are cut by the application of a drawing force and/or a shearing force while or immediately after contacting them with a medium maintained at a temperature lower than −5° C. according to the process of the present invention, a bundle of discontinuous filaments containing the sharp-ended filaments of the present invention at a content determined in accordance with the temperature of the cooling medium can be obtained. If the temperature of the cooling medium is higher than −5° C., most cut ends have a columnar shape, as shown in FIG. 19. By appropriately changing the mixing ratio of the sharp-ended filaments of the present invention, the feel to the touch and the elasticity of the product can optionally be changed.

The filament of the present invention has on at least one terminal thereof an obliquely cut sharp end. Accordingly, the filament of the present invention has a smooth and soft feel to the touch and is rich in respect to elasticity. Furthermore, the occurrence of breakage or the formation of flies at the post-processing step is much reduced as compared with the conventional sharp-ended filaments. When the filaments are prepared by cooling with a cooling medium, by appropriately changing the temperature of the cooling medium, it is possible to produce a variety of slivers, for example, an ordinary bundles of continuous filaments having a uniform section and bundles of discontinuous filaments having a sharp-ended filament mixing ratio in the range of from a very low ratio to 100%, according to the intended use.

A spun yarn containing at least 15% of such sharp-ended filaments can give a product having a soft and smooth feel to the touch and being rich in respect to elasticity.

The present invention will now be described in detail with reference to embodiments illustrated in the accompanying drawings. FIG. 1 is a step diagram illustrating one embodiment according to the present invention. A bundle 1 of continuous filaments which is divided into individual filaments having a constant width and a uniformly arranged thickness is supplied and brought into contact with a cooling medium maintained at a temperature lower than −5° C. in a low-temperature tank 2 disposed between back rollers 7 and front rollers 8, whereby the rigidity of the filaments is increased and the elongation is reduced. Simultaneously, the bundle is drawn to apply a tensile stress to the bundle and cut the filaments, whereby a bundle 3 of discontinuous filaments is formed. The filaments are crimped by crimpers 4 and 5, and the resulting bundle is contained in a can 6. In an embodiment shown in FIG. 2, an auxiliary cutting device 10 is disposed between middle rollers 9 and the front rollers 8. In this embodiment, the bundle of continuous filaments is contacted with the cooling medium in the low-temperature tank 2 arranged between the back rollers 7 and the middle rollers 9, and immediately thereafter, the filaments are cut with the assistance of the auxiliary cutting device 10 to form a bundle 3 of discontinuous filaments. FIG. 3 is a step diagram of an embodiment suitable for the production of a bundle 3 of discontinuous filaments having an optional shrinkability. In this embodiment, the bundle 1 of continuous filaments is heated and softened by a pair of upper and lower hot plates 11 disposed between the back rollers 7 and the middle rollers 9, and, simultaneously, the bundle is drawn at a draw ratio suitable for obtaining the predetermined shrinkability. Then the bundle is contacted with the cooling medium maintained at a temperature lower than −50° C. in the low-temperature tank 2 disposed between the middle rollers 9 and the front rollers 8 and, simultaneously, a tensile stress is given to the bundle by a pair of rollers to cut the filaments and form a bundle 3 of discontinuous filaments.

Figure 4:
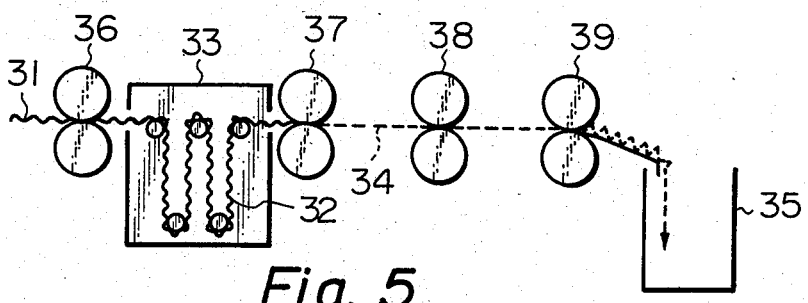

FIG. 4 is a step diagram showing an embodiment in which filaments are cut in the crimp-retained state. A bundle 31 of single filaments having crimps in which the individual filaments having a certain width and a uniformly arranged thickness are separated is overfed by back rollers 36 to supply the bundle into a low-temperature tank 33 while restoring and developing original crimps 32, and the bundle is contacted with a cooling medium maintained at a temperature lower than −20° C. in the low-temperature tank 33, whereby the rigidity of the filaments is increased and the elongation is reduced to almost zero, and the crimps are fixed. Then a certain breaking draft is given to the sliver between middle rollers 37 and break rollers 38 to produce a shearing stress or concentrating stress in the fixed crimps and to cut the single filaments, and the resultant bundle 34 of discontinuous filaments is drawn by a front roller 39 and contained in a can 35.

Figure 5:
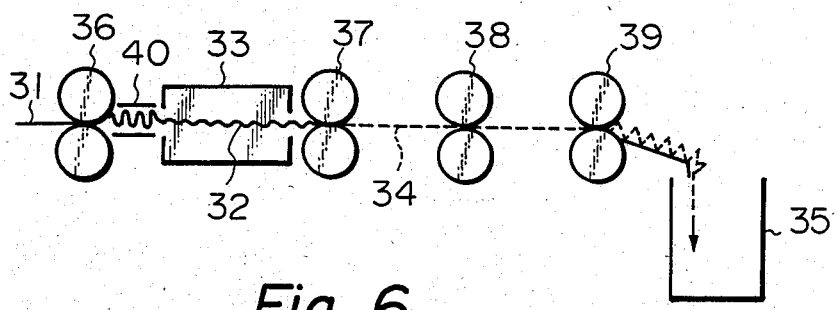

FIG. 5 is a step diagram showing an embodiment in which a crimper 40 is disposed in the back rollers 36 and middle rollers 37 to give appropriate crimps 32 to the bundle 31 of uncrimped or weakly crimped continuous filaments, and the bundle is fed into the low-temperature tank 33 and a breaking draft is given to the bundle between the middle rollers 37 and the break roller 38 to cut the filaments and form a bundle 34 of discontinuous filaments.

Figure 6:
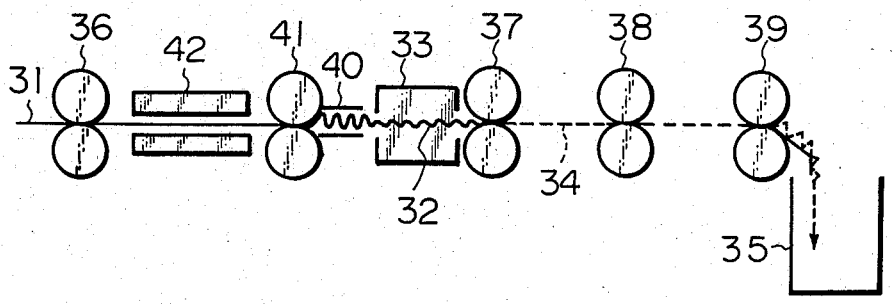

FIG. 6 is a step diagram showing an embodiment suitable for preparing a bundle 34 of discontinuous filaments having an optional shrinkability. In this embodiment, the bundle 31 of continuous filaments is heated and softened by a pair of upper and lower hot plates 42 disposed between the back rollers 36 and drawing rollers 41, and, simultaneously, the bundle is drawn at a draw ratio suitable for obtaining the predetermined shrinkability. Then crimps 32 are given to the filaments by the crimper 40, the bundle is supplied into the low-temperature tank 33, and a certain breaking draft is given between the middle rollers 37 and the break rollers 38 to produce a shearing stress or concentrating stress in the fixed crimps and to cut the single filaments. The formed bundle 34 of discontinuous filaments is contained in the can 35.

Figure 7:
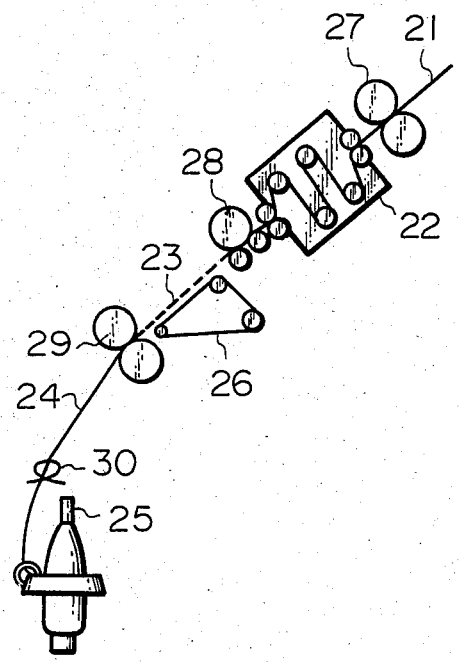

FIG. 7 is a step diagram illustrating an embodiment of the direct spinning process. In this embodiment, a bundle 21 of continuous filaments is supplied and is contacted with a cooling medium maintained at a temperature lower than −5° C. in a low-temperature tank 22 disposed between back rollers 27 and middle rollers 28, and the filaments are drawn and cut between the middle roller 28 and front rollers 29 to form a bundle 23 of discontinuous filaments. The bundle is twisted according to the ring traveller system to form a spun yarn 24, and the spun yarn 24 is wound on a paper spool 25. Incidentally, reference numerals 26 and 30 represent an apron band and a snail wire guide, respectively.

For the draw-cutting in the present invention, there may be utilized commercially available draw-cutting machines, for example, OM Tow Reactors such as Type TR-W II, Type TR-W III, and Type TR-W IV (manufactured by OM Manufacturing Co., Japan), OM Sliver Reactors such as Type TR-C III (manufactured by OM Manufacturing Co., Japan), Seydel Tow to Top System such as Type 671, Type 671-S, Type 673, Type 675, Type 670, Type 677, and Type 770 (manufactured by Seydal Co., Germany), Tematex converters such as Type MS-T19, Type MST9, and Type MST10 (manufactured by Tematex Co., Italy), Duranitre converters such as Type 970 (manufactured by Duranitre Co., Belgium), Turbo converters such as Turbo Poly-Breaker and Turbo Stapler (manufactured by Turbo Co., U.S.A.), and Howa converters such as Toray Stapler EJ-TR (manufactured by Howa Industrial Co., Japan).

The present invention will now be described in detail with reference to the following non-limitative examples.

Various properties as referred to herein were determined as follows:

| | |
|---|---|
| Single filament denier: | JIS (Japanese Industrial Standards) L 1074; |
| Tensile strength: | JIS L 1069; |
| Tensile elongation: | JIS L 1069; |
| Loop strength: | JIS L 1069; |
| Loop elongation: | JIS L 1069; |
| Degree of shrinkage: | DuPont Technical Information "ORLON" Bulletin OR-112 |
| Parallelism: | Lindsley method |
| U %: | Uster Evenness Tester (Zellweger Co.) |

-continued

| | |
|---|---|
| Number of crimps: | JIS L 1074 |
| Curliness: | JIS L 1074 |

EXAMPLE 1 A 500,000-denier tow composed of 3-denier polyacrylonitrile filaments was set in an apparatus as shown in FIG. 1 and was spun under the following conditions:

Cooling medium: nitrogen gas
Ambient temperature in low-temperature tank: −50° C.
Residence time: 30 seconds
Breaking draft ratio: 2.04
Spinning speed: 100 m/min For comparison, the above-mentioned tow was set in an OM tow reactor (supplied by OM Manufacturing Co.) and was spun under the following conditions:

Hot plate temperature: 120° C.
Hot draw ratio: 1.218
Total draft ratio (break draft ratio): 6.51 (2.53)
Spinning speed: 100 m/min The obtained results were compared with the results obtained above.

The above-mentioned 3-denier filaments were cut biased into staple fibers having a length of 70 to 127 mm, and the staple fibers were supplied to a roller card at the cardspinning step and were spun under the following conditions:

Spinning speed: 30 m/min

The processing operation adaptability and physical properties of the sliver were compared with the results obtained above.

TABLE 1

| | Physical Properties of Single Filaments | | | |
|---|---|---|---|---|
| | | Spinning Method | | |
| | Starting Filaments | Present Invention | Perlohrke System | Roller Card System |
| Denier (d) | 2.96 | 3.05 | 2.5 | 2.96 |
| Dry tenacity (g/d) | 3.47 | 3.52 | 4.01 | 3.46 |
| Dry elongation (%) | 46.5 | 45.2 | 16.2 | 46.5 |
| Loop strength (g/d) | 4.74 | 4.65 | 1.21 | 4.75 |
| Loop elongation (%) | 28.1 | 27.5 | 0.81 | 28.2 |

TABLE 2

| | Present Invention | Perlohrke System | Roller Card System |
|---|---|---|---|
| Spinnability | good | draw-cutting impossible at breaking draft ratio lower than 2.1 | good |
| Amount (g/Kg) of flies or waste fibers | 0.2 | 0.9 | 0.3 |
| Shrinkage degree (%) | 4.0 | 26.5 | 1.2 |
| Parallelism | 86.0 | 86.0 | 65.0 |
| Neps (per 100 g) | 0 | 0 | 36.0 |
| U (%) | 2.0 | 2.3 | 3.6 |

Ring-spun yarns and products prepared from the above-mentioned slivers (in the case of the tow reactor, the sliver was crimped and subjected to relax setting) by conventional spinning procedures were compared.

TABLE 3

| | Present Invention | Tow Reactor (Perlohrke System) | Roller Card System |
|---|---|---|---|
| Properties of Yarn | | | |
| Count number (Nm) | 1/40.2 | 1/40.3 | 1/40.1 |
| Count-tenacity product (Km) | 15.3 | 13.2 | 15.2 |
| U (%) | 12.0 | 12.2 | 14.3 |
| Shrinkage degree (%) | 4.3 | 3.2 | 3.5 |
| Yarn defects (per 100,000 m) | 20.5 | 26.5 | 40.8 |
| Properties of Product | | | |
| Resiliency | good | no resiliency | good |
| Dyeability | good | lightly dyed with reduced dyeability | good |
| Adaptability to hot polisher | good | heat distortion | good |

When a tow having a total denier of 500,000 was contacted with the cooling medium maintained at −50° C., it could be cut at a breaking draft ratio of 2.04 but could not be cut at a breaking draft ratio of 2.1 or less, after hot drawing at a draw ratio of 1.218, according to the conventional method, in which a tow reactor was used. Moreover, the formation of flies or waste fibers was reduced and the amount of fly or waste fiber was less than in the conventional card method. Also, and the obtained sliver had a low degree of shrinkage and the relax setting operation, which is indispensable for the tow reactor method, was not necessary. The sliver obtained according to the present invention was more excellent than the sliver obtained according to the card method in respect to U %, parallelism, and the formation of neps, and the manufacturing speed was higher than in the card method.

With respect to the yarn properties, filament damages were reduced in the process of the present invention as compared with the conventional method, in which a tow reactor was used, the count-tenacity product was higher than that in the tow reactor method, and the yarn obtained according to the process of the present invention was more excellent than the yarn obtained according to the card method in respect to U % and the prevention of apparent defects. Moreover, the product obtained according to the present invention was excellent in respect to resiliency, dyeability, and adaptability to the hot polisher, as was the product obtained according to the card method.

EXAMPLE 2

A 500,000-denier tow composed of 3-denier polyacrylonitrile filaments was spun in an apparatus as shown in FIG. 3 under the following conditions:

Conditions of the Present Invention:
Hot plate temperature: 120° C.
Cooling medium: nitrogen gas
Ambient temperature in low-temperature tank: −50° C.
Residence time: 30 seconds
Breaking draft ratio: 2.04
Spinning speed: 100 m/min
Tow Reactor Conditions:
Hot plate temperature: 120° C.
Total draft ratio
(breaking draft ratio): 6.51 (2.53)
Ambient temperature in draw-breaking zone: 20° C.
Spinning speed: 100 m/min The hot draw ratio on a hot plate and the shrinkage degree of the obtained sliver were compared with those in the conventional method using a tow reactor.

The obtained results are shown in FIG. 8. In the conventional method (see curve D), since draw-breaking was carried out after hot drawing, the single filaments had to be drawn to the point of elongation at breakage, and, therefore, shrinkage by draw-breaking was added to shrinkage by hot drawing. Accordingly, in the range where the hot draw ratio was relatively high, the shrinkage degree was proportional to the hot draw ratio but when the hot draw ratio was low, a shrinkage degree lower than a certain value could not be obtained because of the above-mentioned additional shrinkage. Therefore, the range of attainable shrinkage degrees was very narrow. In contrast, in the present invention (see curve C), the shrinkage degree was increased to the maximum level substantially in proportion to the hot draw ratio, and it was confirmed that a sliver having an optional shrinkage degree can easily be obtained according to the present invention.

EXAMPLE 3

Figure 2:
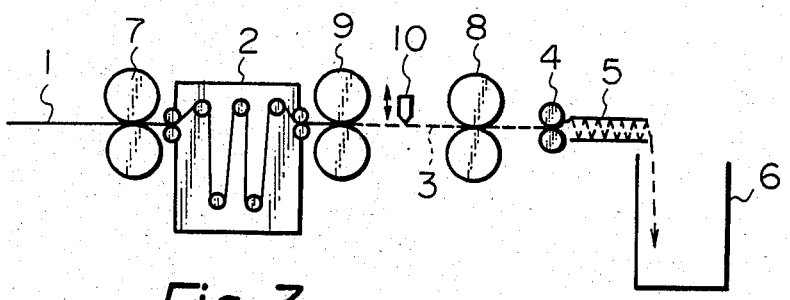
Figure 3:
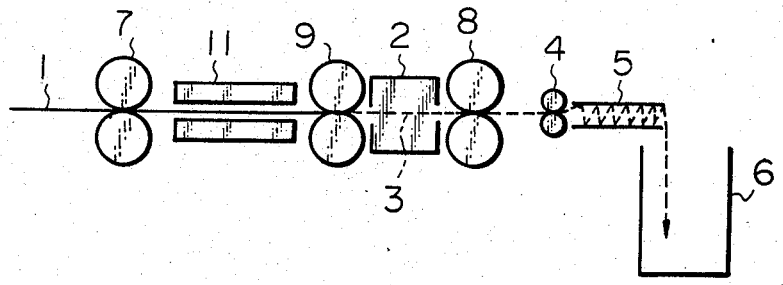

A 450,000-denier tow composed of 3-denier polyester filaments was set in an apparatus as shown in FIG. 2 and was spun under the following conditions:

Cooling medium: nitrogen gas
Ambient temperature in low-temperature tank: −100° C.
Residence time: 45 seconds
Breaking draft ratio: 2.50
Spinning speed: 100 m/min The above-mentioned tow was set in an OM tow reactor and was spun under the following oonditions:

Hot draw temperature: 140° C.
Hot draw ratio: 1.281, 1.457 or 1.689
Total draft ratio (breaking draft ratio): 6.51 (2.56)
Ambient temperature in draw-breaking zone: 20° C.
Spinning speed: 100 m/min The results were compared with the results obtained above.

The above-mentioned 3-denier filaments were cut biased in staple fibers having a length of 70 to 127 mm, and the staple fibers were supplied to a roller card at the cardspinning step and were spun under the following conditions:

Spinning speed: 30 m/min

This method was compared with the above-mentioned method of the present invention with respect to spinnability, the physical properties of the single filaments, and the sliver quality.

TABLE 4

| | Spinnability and Physical Properties of Sliver | | | | | |
|---|---|---|---|---|---|---|
| Method | Hot Drawing Conditions | Spinnability | Parallelism (Lindsley Method) | Neps (per 100 g) | U % | Shrinkage Degree (%) |
| Present Invention | not effected | good | 88 | 0 | 2.0 | 3.0 |
| OM Tow Reactor (Perlohrke System) | 140° C. × 1.281 | draw breaking impossible | — | — | — | — |
| OM Tow Reactor (Perlohrke System) | 140° C. × 1.457 | unstable draw breaking | 84 | 0 | 3.5 | 11.3 |
| OM Tow Reactor (Perlohrke System) | 140° C. × 1.689 | good | 88 | 0 | 2.0 | 10.5 |
| Card System | not effected | good | 67 | 52 | 3.6 | 2.9 |

TABLE 5

| | | Properties of Single Filaments | | | | | | | |
|---|---|---|---|---|---|---|---|---|---|
| | | Physical Properties After Spinning | | | | Physical Properties After Relax Setting at 110° C. | | | |
| Method | Hot Drawing Conditions | Tensile Strength (g/d) | Tensile Elongation (%) | Loop Strength (g/d) | Loop Elongation (%) | Tensile Strength (g/d) | Tensile Elongation (%) | Loop Strength (g/d) | Loop Elongation (%) |
| Present Invention | not effected | 5.4 | 52 | 8.5 | 41 | 5.2 | 56 | 8.5 | 43 |
| OM Tow Reactor (Perlohrke System) | 140° C. × .1689 | 6.5 | 15 | 7.6 | 11 | 5.0 | 24 | 7.6 | 18 |
| Card System | not effected | 5.1 | 54 | 8.6 | 43 | 5.1 | 54 | 8.6 | 43 |

| | Properties of Starting 3-Denier Polyester Filaments | | | |
|---|---|---|---|---|
| Method | Tensile Strength (g/d) | Tensile Elongation (%) | Loop Strength (g/d) | Loop Elongation (%) |
| Present Invention | 5.1 | 57 | 8.6 | 44 |
| OM Tow Reactor (Perlohrke System) | | | | |
| Card System | | | | |

Polyester filaments have a high tenacity and elongation. Accordingly, in the conventional tow reactor method, drawbreaking was impossible without the hot drawing temperature and hot draw ratio being increased. In contrast, according to the present invention, breaking was possible at such a low breaking draft ratio as 2.50. Moreover, the sliver obtained according to the present invention was more excellent than the sliver obtained according to the conventional card method respect to parallelism and prevention of the formation of neps.

When polyester filaments are hot-drawn as in the conventional tow reactor method, crystallization takes place to reduce not only tensile elongation but also loop strength and elongation, with the result that the filaments become brittle. Accordingly, in the tow reactor method, even if the polyester filaments are subjected to a relax setting treatment at 110° C. after a hot drawing treatment, the physical properties of the filaments can not be recovered. In contrast, in the present invention, no substantial shrinkage is manifested and a reduction of the physical properties does not result. In addition, a high-quality sliver can be manufactured at a high speed.

EXAMPLE 4

A 500,000-denier tow composed of 3-denier polyacrylonitrile filaments was set in an apparatus as shown in FIG. 4 and was spun under the following conditions:

Crimps: density of 12 crimps per inch, curliness of 13%, crimp angle of 60° $\leqq\theta\leqq$120°

Overfeed ratio: 8%

Cooling medium: nitrogen gas

Ambient temperature in low-temperature tank: −100° C.

Residence time: 45 seconds

Breaking draft ratio: 2.08

Spinning speed: 100 m/min

The above-mentioned tow was set in an OM tow reactor (supplied by OM Manufacturing Co.) and was spun under the following conditions:

Hot plate temperature: 120° C.

Hot draw ratio: 1.218

Residence time: 6 seconds

Total draft ratio (breaking draft ratio): 6.51 (2.53)

Ambient temperature in draw-breaking zone: 20° C.

Spinning speed: 100 m/min

The results obtained were compared with the results obtained above.

The above-mentioned 3-denier filaments were cut biased into staple fibers having a length of 70 to 127 mm. The staple fibers were supplied to a roller card at the card- spinning step and were spun under the following conditions:

Spinning speed: 30 m/min

This method was compared with the above-mentioned method of the present invention with respect to operation adaptability and the properties of the sliver.

TABLE 6

| | Physical Properties of Single Filaments | | | |
|---|---|---|---|---|
| | | Spinning Method | | |
| | Starting Filaments | Present Invention | Tow Reactor (Perlohrke System) | Card System |
| Denier (d) | 2.96 | 2.95 | 2.5 | 2.96 |
| Dry strength (g/d) | 3.47 | 3.50 | 4.01 | 3.46 |
| Dry elongation (%) | 46.50 | 46.20 | 16.20 | 46.50 |
| Loop strength (g/d) | 4.74 | 4.72 | 1.21 | 4.75 |
| Loop elongation (%) | 28.10 | 28.00 | 0.81 | 28.20 |

TABLE 7

| | Method of the Present Invention | Tow Reactor Method (Perlohrke System) | Card System |
|---|---|---|---|
| Spinnability | good without mass cutting | draw breaking impossible at breaking draft ratio lower than 2.1 | good |
| Amount (g/Kg) of flies or waste fibers | 0.2 | 0.9 | 0.3 |
| Shrinkage degree (%) | 3.0 | 26.5 | 1.2 |
| Parallelism | 87.0 | 87.0 | 65.0 |
| Neps (per 100 g) | 0 | 0 | 43.0 |
| U % | 2.1 | 2.4 | 3.5 |
| Residual crimp number (per inch) | 11.0 | 0 | 12.0 |
| Residual curliness (%) | 10.0 | 0 | 12.0 |

Ring-spun yarns and products prepared from the above-mentioned slivers (in the case of the tow reactor, the sliver was crimped and subjected to relax setting) by customary spinning procedures were compared.

TABLE 8

| | Present Invention | Tow Reactor (Perlohrke System) | Roller Card System |
|---|---|---|---|
| Properties of Yarn | | | |
| Count number (Nm) | 1/40.1 | 1/40.3 | 1/40.1 |
| Count-tenacity product (Km) | 15.50 | 13.20 | 15.20 |
| U (%) | 12.40 | 12.20 | 14.30 |
| Shrinkage degree (%) | 3.10 | 3.20 | 3.50 |
| Yarn defects (per 100,000 m) | 18.50 | 26.50 | 40.80 |
| Properties of Product | | | |
| Resiliency | good | no resiliency | good |
| Dyeability | good | lightly dyed with reduced dyeability | good |
| Adaptability to hot polisher | good | heat distortion | good |

When a tow having a total denier of 500,000 was contacted with the cooling medium maintained at −100° C., it could be cut at a breaking draft ratio of 2.08 even after 8% overfeeding but could not be cut at a breaking draft ratio of 2.1 or less, after hot drawing at a draw ratio of 1.218, according to the conventional method, in which a tow reactor was used. Moreover, the formation of flies or waste fibers was reduced and the amount of flies or waste fibers was less than in the conventional card method. Also, the obtained sliver had a low degree of shrinkage, the original crimps were retained, and the relax setting operation, which was indispensable for the fixation of crimps in the tow reactor method, was not necessary. The sliver obtained according to the present invention was more excellent than the sliver having no shrinkage obtained by the card method in respect to U %, parallelism, and the formation of neps. Also, the manufacturing speed was higher than in the card method.

With respect to the yarn properties, filament damages were reduced in the process of the present invention as compared with the conventional method, in which a reactor was used, the count-tenacity product was higher than in the tow reactor method, and the yarn obtained by the process of the present invention was more excellent than the yarn obtained by the card method in respect to U % and the prevention of apparent defects. Moreover, the product obtained according to the present invention was excellent in respect to resiliency, dyeability, and adaptability to the hot polisher, as was the product obtained according to the card method.

EXAMPLE 5

In order to compare the process of the present invention with the conventional method with respect to the tensile force necessary for cutting, a 300-denier sliver composed of 3-denier polyacrylonitrile filaments (12 crimps per inch; crimp angle, 60° $\leqq\theta\leqq$120° ) was stretched by a Tensilon tester under the conditions described below to obtain S—S curves. The obtained results are shown in FIG. 13.

Conventional Method:

The sliver was drawn and cut at an ambient temperature of 20° C. (see curve C).

Process of the Present Invention:

The sliver of single filaments was relaxed by 10% in the longitudinal direction, and in a state where crimps were thus manifested, was cooled for 45 seconds with nitrogen gas maintained at −100° C. and was then drawn and cut (see curve A). Furthermore, in a state where crimps were elongated due to the application of tension, the sliver was cooled at −100° C. for 45 seconds and was then drawn and cut (see curve B).

EXAMPLE 6

Figure 15:
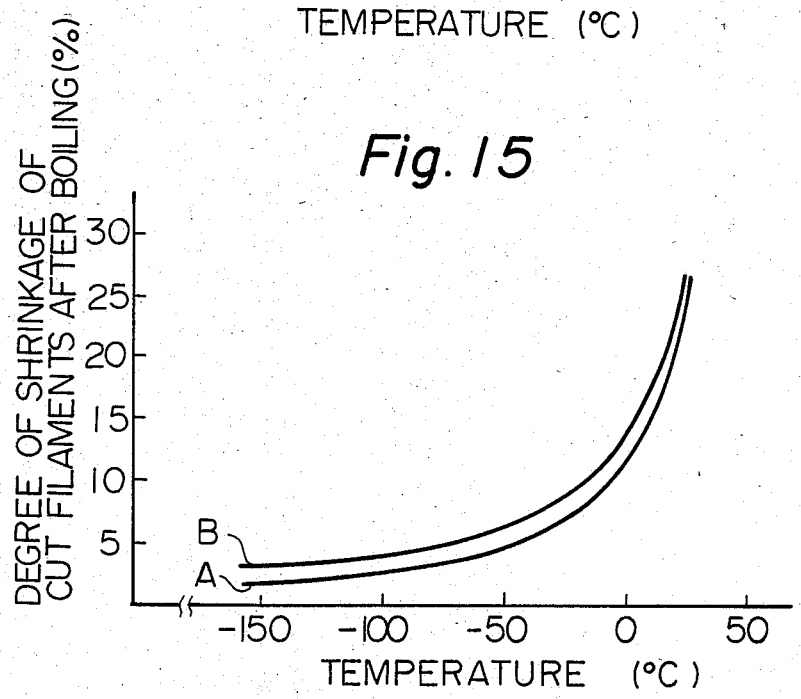
FIG. 15 is a diagram illustrating the relationship between the temperature of the cooling medium at the step of cutting acrylic synthetic filaments (marketed under the D tradename of Cashmilon ®) and the degree of shrinkage of the cut single filaments after boiling.

The same sample of sliver as used in Example 5 was cooled with nitrogen gas in a state where crimps were manifested and fixed by cooling at <100° C. with nitrogen gas or where crimps were elongated, and the relationship between the cooling temperature, the tensile force necessary for cutting, and the degree of shrinkage at the cutting temperature were examined. The obtained results are shown in FIGS. 14 and 15.

Process of the Present Invention:

The sliver was cooled for 45 seconds in a state where crimps were manifested by relaxing the sliver by 10%, and the sliver was drawn and cut (see curve A in FIG. 14).

Comparative Method:

The sliver was cooled for 45 seconds in a state where crimps were elongated, and the sliver was drawn and cut (see curve B in FIG. 14).

From the foregoing results, it will readily be understood that if the sliver is contacted with a cooling medium, cutting is possible at a very low breaking draft ratio and no substantial shrinkability is manifested. It will also be understood that if a breaking draft is given to the sliver in a state where crimps are set, cutting is possible by means of a very small tensile force and the manifestation of shrinkability is controlled to a very low level.

EXAMPLE 7

The same sample of tow as used in Example 5 was overfed and cooled with nitrogen gas maintained at −100° C. to set crimps, and the relationship between the tensile force necessary for cutting and the overfeed ratio was examined. The obtained results are shown in FIG. 16.

EXAMPLE 8

A 500,000-denier tow composed of 3-denier polyacrylonitrile filaments was set in an apparatus as shown in FIG. 4, was contacted with a cooling medium maintained at 0° to −120° C., and was then cut and spun under the following conditions:

Cooling medium: nitrogen gas

Ambient temperature in low-temperature tank: 0° to −120° C.

Breaking draft ratio: 2.52

Residence time: 20 seconds

Spinning speed: 100 m/min

The obtained discontinuous filaments were compared with respect to characteristics, physical properties, and operation adaptability.

TABLE 9

| | Characteristics and Physical Properties of Single Filaments Cooling Medium Temperature (°C.) | | | | |
|---|---|---|---|---|---|
| | 0 | −20 | −40 | −80 | −120 |
| Mixing ratio (%) of obliquely cut columnar filaments | 5 | 21 | 41 | 92 | 100 |
| Crimps of starting filaments | lost | slightly re-tained | re-tained | re-tained | re-tained |
| Dry strength (g/d) | 3.22 | 3.23 | 3.21 | 3.25 | 3.20 |
| Dry elongation (%) | 27.50 | 33.00 | 36.50 | 40.50 | 42.50 |
| Loop strength (g/d) | 3.82 | 4.65 | 4.75 | 5.15 | 5.10 |
| Loop elongation (%) | 15.00 | 23.50 | 30.50 | 40.10 | 40.20 |
| Shrinkage degree (%) | 14.50 | 10.20 | 6.50 | 3.40 | 3.00 |

TABLE 10

| | Cooling Medium Temperature (°C.) | | | | |
|---|---|---|---|---|---|
| | 0 | −20 | −40 | −80 | −120 |
| Spinnability | mass cutting | good | good | good | good |
| Content (%) of cut fiber shorter than 2" | 42.0 | 23.0 | 16.0 | 12.0 | 10.0 |
| Amount (g/Kg) of flies | 0.9 | 0.6 | 0.4 | 0.2 | 0.2 |
| U % | 4.8 | 3.5 | 2.8 | 2.0 | 2.1 |

Ring-spun yarns and products prepared from the foregoing slivers by customary spinning procedures were examined. Incidentally, the count number of the spun yarn was 1/30 Nm.

TABLE 11

| | Cooling Medium Temperature (°C.) | | | | |
|---|---|---|---|---|---|
| | 0 | −20 | −40 | −80 | −120 |
| Physical Properties of Yarn | | | | | |
| Tenacity (g) | 505.0 | 509.0 | 501.0 | 498.0 | 503.0 |
| Elongation (%) | 13.2 | 18.3 | 19.4 | 20.6 | 20.8 |
| U % | 15.6 | 12.8 | 12.4 | 12.5 | 12.3 |
| Shrinkage degree (%) | 16.2 | 10.3 | 6.8 | 4.3 | 4.1 |
| Feel of Product | x | ○ | ◎ | ◎ | ◎ |

Note
x: rough and hard
○: slightly soft and certain resiliency
◎: soft, good resiliency and highly elastic From the foregoing results, it will be seen that when a tow having a total denier of 500,000 and an ordinary uniform section is contacted with a cooling medium maintained at a temperature lower than −5° C., the drafting property is improved, the formation of short, cut fibers or flies is reduced, and the U % is improved. Also, a sliver having an excellent quality can be manufactured at a high speed.

Moreover, in connection with the yarn properties, various advantages are attained. For example, the degree of shrinkage is reduced, the elongation is increased, and the tenacity is sufficient.

Furthermore, in the products, the higher the mixing ratio of the obliquely cut columnar filaments is, the larger the amount of residual crimps is and the better the feel is.

EXAMPLE 9

Continuous filament slivers composed of 200 3-denier acrylic filaments (Cashmilon ®), 200 15-denier acrylic filaments (Cashmilon ®), and 200 3-denier cupra filaments (Bemberg ®), respectively, were cooled for 20 seconds at an ambient temperature of −80° C. and were then cut by the application of a drawing force. The frequency of appearance of obliquely cut columnar filaments, the shape of the cut face, and the angle of the top end were examined. The obtained results are shown in Table 12.

TABLE 12

Figure 20A:
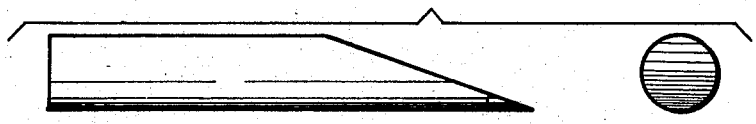
FIGS. 20A through 20F are side views showing examples of sharpened top ends of filaments of the present invention and front views showing the cut faces.
Figure 20B:
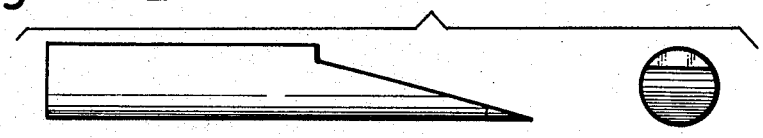
Figure 20C:
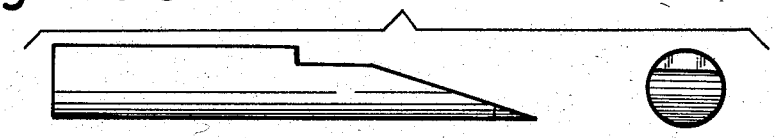
Figure 20D:
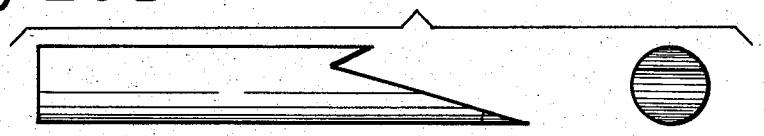
Figure 20E:
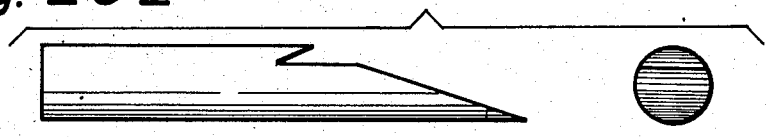
Figure 20F:
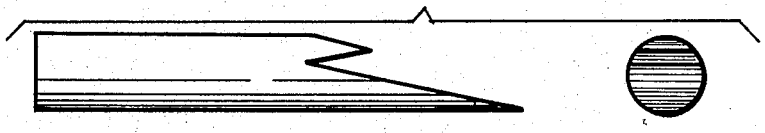

| Filaments | Denier (d) | Frequency (%) | Results |
|---|---|---|---|
| Cashmilon ® | 3 | 92 | The majority of the filaments had the cut face shapes shown in FIG. 20A while some of the filaments had the cut face shapes shown in FIGS. 20B, 20D, and 20F. The cut faces had certain convexities and concavities. The top end angle $\alpha$ was in the range of $5° \leqq \alpha \leqq 30°$. |
| Cashmilon ® | 15 | 98 | The majority of the filaments had the cut face shapes shown in FIG. 20B while filaments about 90% of the total filaments had the cut face shapes shown in FIGS. 20B, and 20A. The cut faces were very smooth, and the top end angle $\alpha$ was in the range of $5° \leqq \alpha \leqq 30°$. |
| Bemberg ® | 3 | 98 | The frequency of the filaments having the cut face shapes shown in FIG. 20A was higher than 90%. The cut faces were very smooth, and the top end angle $\alpha$ was in the range of $30° \leqq \alpha \leqq 50°$. |

From the results shown in Table 12, the following can be seen.

In the case of acrylic filaments (Cashmilon ®), if the cooling medium temperature was −80° C., the frequency of appearance of the obliquely cut columnar filaments was higher than 90%, and this frequency was higher in the case of 15-denier filaments than in the case of 3-denier filaments. Furthermore, the cut faces were smoother in the case of 15-denier filaments than in the case of 3-denier filaments. In the case of both the 3-denier filaments and the 15-denier filaments, the top end angle $\alpha$ was in the range of $5° \leqq \alpha \leqq 30°$, and most of the cut ends had the shapes shown in FIGS. 20A and 20B. Also, high-quality materials having a smooth and soft feel to the touch and a high elasticity could be stably obtained.

In the case of cupra filaments (Bemberg ®), if the cooling medium temperature was −80° C., the frequency of appearance of obliquely cut columnar filaments was as high as 98% and the cut faces were smooth. Furthermore, the top end angle $\alpha$ was in the range of $30° \leqq \alpha \leqq 50°$, and filaments having the cut end shapes shown in FIG. 20A could be stably obtained.

We claim:

1. In a process for the preparation of discontinuous filament bundles composed of synthetic fibers by applying a drawing force or a drawing force and supplementary shearing force to a bundle of continuous filaments, the improvement which comprises feeding the bundle in the crimp-retained state, made of crimped acrylic type filaments, into a cooling zone maintained at a temperature from −20° C. to −195° C. before applying the drawing force, whereby the discontinuous filaments of the resisting bundle retain their crimp and the shrinkage is controlled.

* * * * *